US005708943A

United States Patent [19]

Applegate et al.

[11] Patent Number: 5,708,943

[45] Date of Patent: Jan. 13, 1998

[54] COMPLIANT DOCTOR BLADE SURFACE HAVING MOLYBDENUM DISULFIDE

[75] Inventors: Steven L. Applegate; Peter W. Bracken; Jeffery R. Brener; Martin V. DiGirolamo; Samuel E. Mullinix, Jr., all of Lexington; Donald W. Stafford, Richmond; Peter E. Wallin, Lexington, all of Ky.

[73] Assignee: Lexmark International, Inc., Lexington, Ky.

[21] Appl. No.: 724,881

[22] Filed: Oct. 3, 1996

[51] Int. Cl.[6] ..... G03G 15/08

[52] U.S. Cl. ..... 399/284

[58] Field of Search ..... 399/274, 275, 399/284

[56] References Cited

U.S. PATENT DOCUMENTS

| | | | |
|---|---|---|---|
| 2,951,053 | 8/1960 | Reuter et al. | 260/28 |
| 3,630,146 | 12/1971 | Shields | 101/351 |
| 3,936,183 | 2/1976 | Sadamatsu | 355/15 |
| 4,150,955 | 4/1979 | Samuelson | 51/298 |
| 4,279,500 | 7/1981 | Kondo et al. | 355/15 |
| 4,526,952 | 7/1985 | Zeitler et al. | 524/496 |
| 5,085,171 | 2/1992 | Aulick et al. | 118/653 |
| 5,099,783 | 3/1992 | Bourgeois | 118/213 |
| 5,185,496 | 2/1993 | Nishimura et al. | 118/658 |
| 5,376,454 | 12/1994 | Sugasawa et al. | 428/421 |
| 5,397,600 | 3/1995 | Shibata et al. | 427/358 |
| 5,456,734 | 10/1995 | Ryoke et al. | 51/295 |
| 5,623,718 | 4/1997 | Bracken et al. | 399/284 |

FOREIGN PATENT DOCUMENTS

| | | |
|---|---|---|
| 60-229061 | 11/1985 | Japan . |
| 3-27068 | 2/1991 | Japan . |
| 4-60666 | 2/1992 | Japan . |

*Primary Examiner*—Joan H. Pendegrass
*Attorney, Agent, or Firm*—John A. Brady

[57] ABSTRACT

The conductive film (3) of a compliant doctor blade has dispersed particles of molybdenum disulfide, as well as dispersed particles of grit and conductive filler. The molybdenum disulfide eliminates filming of toner. The molybdenum disulfide may be a surface powder since the anti-film action occurs at the pre-nip and therefore is not lost by the molybdenum disulfide wearing away at the nip.

10 Claims, 2 Drawing Sheets

COMPLIANT DOCTOR BLADE SURFACE HAVING MOLYBDENUM DISULFIDE

TECHNICAL FIELD

This invention relates to electrophotographic development and, more particularly, relates to a compliant doctor blade operative on a developer roller.

BACKGROUND OF THE INVENTION

U.S. Pat. No. 5,085,171 to Aulick et al, assigned to the same assignee to which this application is assigned, is directed to a compliant doctor blade having a thin metal outer layer on a grit surface which faces the developer roller. This replaces prior rigid doctor blades which therefore could permit the toner layer of the developer roller to vary with surface variations in the doctor blade itself and the developer roller it comes in contact with. Such variations cause variations in the visible image made by the toner, both print and graphics. A compliant doctor blade ideally eliminates such variations.

U.S. Pat. No. 5,623,718 to Bracken et al., filed Sep. 6, 1995, entitled "Extended Life Compliant Doctor Blade With Conductive Abrasive Member" describes subject matter sold in the United States commercially by the assignee of this application for more than a year from the filing of this application. This doctor blade constitutes a compliant doctor blade in which the compliant, doctoring member has a solid binder containing dispersed grit particles and a conductive filler. Such a compliant member extends the functioning life of the doctor blade. Additionally, this doctor blade has a rigid front extension to form a barrier to almost all of the area in back of the nip of the compliant member and the developer roller. This eliminates the potential for a wedge of toner to form at the nip. When such a wedge forms, it interferes with the ability of the doctor blade to meter the correct amount of toner. Also, this wedge results in toner tending to begin fusing into the nip area of the doctor blade and the developer roller.

A significant problem with such flexible doctor blades is that toner tends to coagulate and bond to the doctor blade in the form of a film in the nip region between the blade and developer. This phenomenon is termed "filming." It appears that this occurs as a function of toner particle size, it being more likely to occur when the particle size is relatively small, such as 8 microns. The filmed areas start as a small initiation point in the pre-nip and gradually grow across the nip. The filmed areas change the surface of the doctor blade, which disrupts toner flow. Furthermore, the filmed areas prevent electrical current from passing between the doctor blade and the developer roller, causing non-uniformity of toner charge. This results in a dramatic print defect called "streaks" where white streaks are seen in black areas and in gray scales. This effect is irreversible.

The likelihood of toner filming is increased by applications that print low-coverage images. That increases the printing yield of the developer and therefore the number of revolutions of the developer roller in contact with the doctor blade. This increased churning of the toner very often leads to filming of the foregoing compliant doctor blades, as well as steel doctor blades.

This invention differs most radically from the foregoing extended life doctor blade in that molybdenum disulfide is added to the solid binder in addition to the grit particles and conductive filler. Molybdenum disulfide is well known as a solid lubricant, but is not used in the electrical contact surface of any item similar to a doctor blade. The following references disclose uses of molybdenum disulfide: U.S. Pat. Nos. 2,951,053 to Reuter et al, 3,630,146 to Shields; 3,936,103 to Sadamatsu; 4,150,955 to Samuelson; 4,279,500 to Kondo et al; 4,526,952 to Zeitler et al; 5,099,783 to Bourgeois; 5,185,496 to Nishimura et at; 5,376,454 to Sugasawa et al; 5,397,600 to Shibata et al; and 5,456,734 to Ryoke et al.

DISCLOSURE OF THE INVENTION

In accordance with this invention, the conductive film of a compliant doctor blade has dispersed particles of molybdenum disulfide, as well as dispersed particles of grit and conductive filler. The molybdenum disulfide naturally occurs in plate form and is used in that form in this invention, of average preferred particle size of 10 microns.

The molybdenum disulfide eliminates filming of toner. This is a function occurring at the pre-nip, since a powder coating of molybdenum disulfide has the same function even after it wears away within the nip.

BRIEF DESCRIPTION OF THE DRAWING

The details of the present invention will be described in connection with the accompanying drawings in which.

BEST MODE FOR CARRYING OUT THE INVENTION

Except for the addition of molybdenum disulfide and the specific amounts of other ingredients of the conductive layer, the structure of the preferred doctor blades is the same as that described in U.S. patent application Ser. No. 08/623,363, filed Mar. 28, 1996, entitled "Compliant Doctor Blade." Much of the following description is identical to that in this application. The content of that application has not been sold or otherwise been rendered prior art for more than a year from the filing of this application.

A preferred flexible doctor blade design is described here which has the desired compliance with the developer roller but does not have a funnel shaped pre-nip and a long, radiused nip region which is seen with flexible doctor blades previously known in the art. This preferred doctor blade does not exhibit the erratic high and low toner flow problems seen with such prior art flexible doctor blades. In the present invention a thin piece of shim material is attached to the bottom surface of a resilient foam layer and, in use, resides between the foam layer and conductive sandpaper which contacts the developer roll. The stiffness of the metal shim in the process direction prevents the foam from deforming in the pre-nip region and causing the undesirable funnel shape. The pre-nip region of the present invention is nearly identical to that found with a steel doctor blade. The stiffness of the metal shim also prevents the undesired long, radiused nip geometry and identically mimics the nip geometry of the steel blade. Since the stiffness the shim provides is effective only in the process direction and not along the length of the developer roller, the overall flexibility of the blade is maintained.

Figure 1:
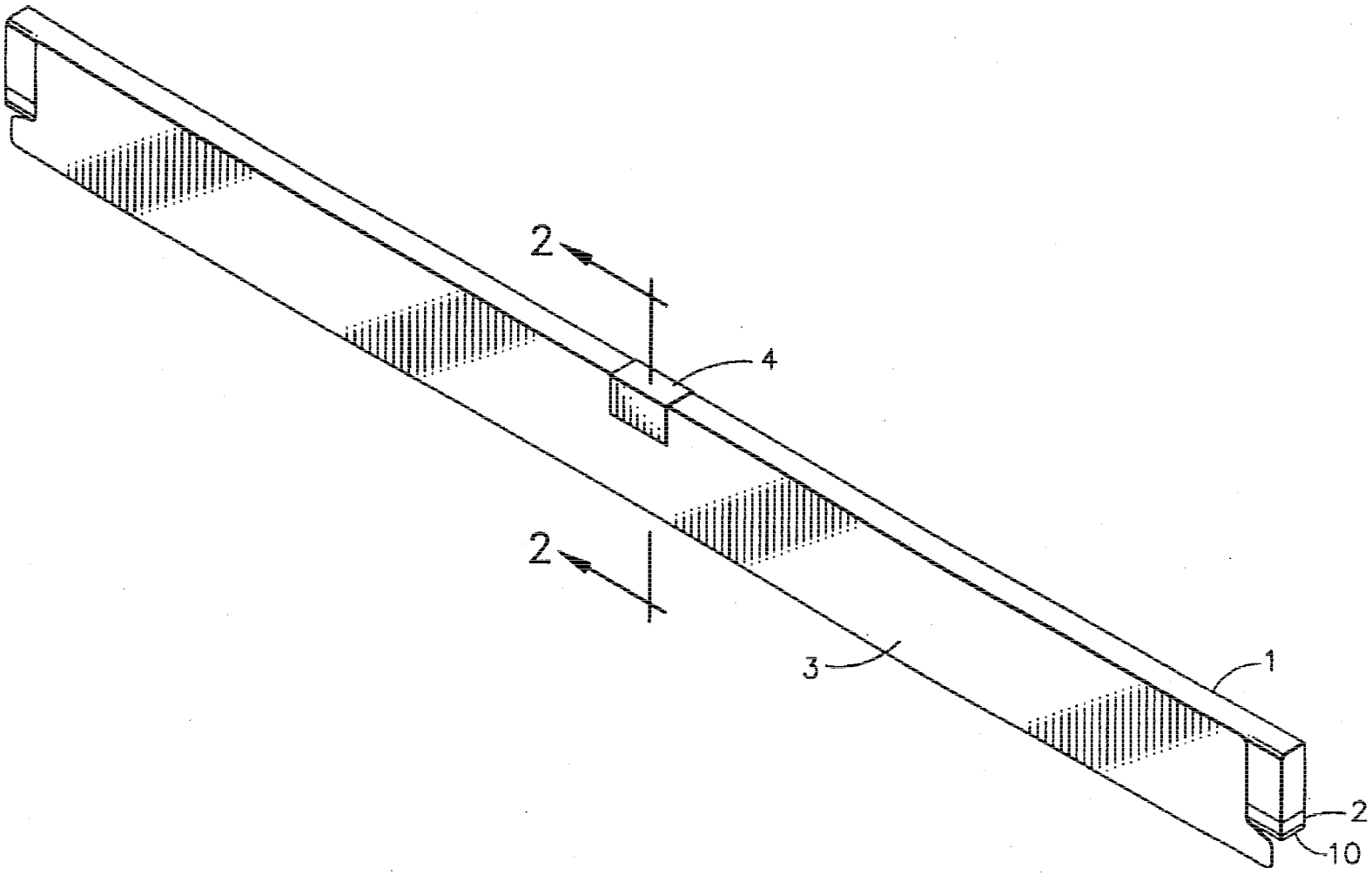
FIG. 1 is a perspective view of the doctor blade.
Figure 2:
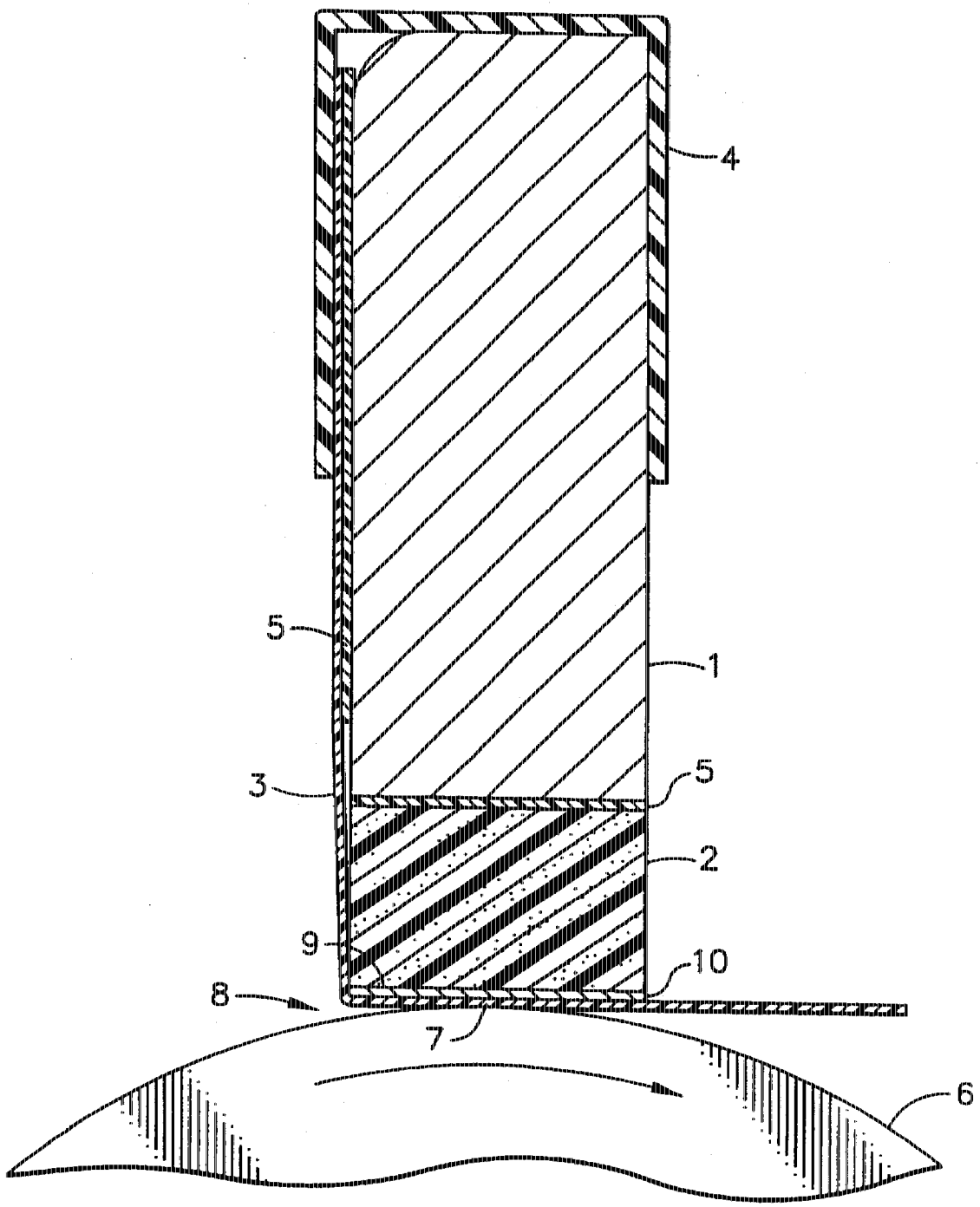
FIG. 2 is a cross-section of the doctor blade.

As shown in FIGS. 1 and 2, the compliant doctor blade of the present invention comprises a support bar (1) of aluminum, preferably, for example, a 4.0 mm×10 mm aluminum 6063-T5 stock bar 231.5 mm in length. Extending the length of bar (1) is a laminate (3) which comprises a compliant backing member carrying on its outside surface (i.e., the surface which contacts the developer roller) a conducting means together with a solid binder having grit particles dispersed throughout the binder. In a preferred embodiment, the compliant backing member is a substrate of compliant polyethylene terephthalate polyester resin film having a thickness of from about 0.002 to about 0.005 inch (i.e., from about 0.051 to about 0.127 mm). Other materials which may be used as the compliant backing member include polyimide and paper. The solid binder which is carded on the compliant backing member is, in a preferred embodiment, a cured polyurethane (e.g., Z001, commercially available from Lord Chemical) having thoroughly dispersed throughout grit particles. These grit particles generally have a particle size of from about 8 to about 20 micrometers, preferable about 20 micrometers in diameter and are preferably a ceramic oxide, such as silicon carbide (e.g., Norbide, commercially available from Norton Corp.). Other grit materials which .are useful in the present invention include aluminum oxide, diamond powder, titanium dioxide, zirconium dioxide, and mixtures thereof.

The compliant backing member also carries a conducting means. This conducting means effectively takes the current which is applied to the doctor blade and conducts it to the developer roller. The conducting means for use in the present invention is one where conductive particles are included in and dispersed throughout the solid binder layer carded by the compliant backing member. Conductive materials which may be used in the present invention include carbon black, graphite, metal fillers, ionic salts, and mixtures thereof. The preferred conducting material is carbon black. The conducting particles included in the solid binder should provide the layer with an electrical resistance of less than about $1\times10^5$ ohms/square.

In accordance with this invention molybdenum disulfide particles are also dispersed throughout the solid binder layer carded by the compliant backing member. The addition of this ingredient eliminates filming, at least when used with acrylic based toner for which this invention is particularly designed (i.e., the toners of the 4039 laser printers commercially sold by the assignee of this invention).

The specific formulation is as follows:

Binder Layer Formulation

| Material | Percent by Weight |
|---|---|
| Polyurethane (Z001 of Lord Chemical) | 15 |
| Molybdenum disulfide (plates 10 um ave. particle size) | 30 |
| Carbon black (XE-2 of Degussa) | 5 |
| Silicon carbide (20 um ave. particle size) | 50 |

The foregoing binder layer formulation is thoroughly mixed and applied as a thin coating (e.g., from about 25 to about 35 microns thick) to the polyester resin film. This slurry is cured to form the conductive layer. The 5% by weight of carbon black results in electrical resistance less than $1\times10^5$ (ten to the fifth power) ohms/square. Loading higher than 5% by weight results in a surface roughness which is too smooth for the correct metering of toner, regardless of the size of the abrasive particle.

The addition of the molybdenum disulfide appears to require somewhat larger sizes of the silicon carbide grit to achieve optimum results. Particle sizes larger than about 20 micrometers create peaks on the surface which scrape too much toner from the surface of the developer roller in a narrow area, resulting in vertical streaks on the printed page. Any type of ceramic oxide grit may be used in the present invention. Examples of such materials include silicon carbide, aluminum oxide, diamond powder, zirconium dioxide, and titanium dioxide within the particle size range specified herein. By being conductive throughout, as the conductive/grit lamination wears from the compliant backing member, the electrical properties of the doctor blade remain consistent.

Laminate (3) is held to bar (1) by any adhesive strong enough to withstand the forces on the laminate. An example of such an adhesive is a commercial dual side adhesive tape (5) comprising 1 mil thick polyester having adhesive on both sides, with total thickness of 0.13 mm, width of 8.5 mm and length coextensive with the length of bar (1).

Developer roller (6) comprises a semiconductive, organic elastomer charged to a predetermined potential by a fixed potential source. Roller (6) is contacted with a supply of charged toner as it rotates clockwise. The toner is normally primarily charged to a polarity the same as the polarity of the roller while having a significant amount of toner charged to the opposite polarity. The sector of developer roller (6) encountering the doctor blade carries such toner, and the toner of opposite polarity is blocked by the charged doctor blade so that only a thin layer of toner passes the doctor blade and that thin layer is charged in great predominance to the correct polarity.

A narrow (preferably about 8 mm wide) conductive band (4) spans bar (1). Band (4) is preferable an approximately 18 mm long section of commercially available copper grounding tape, having a conductive adhesive side which is attached to the laminate (3) across the top of bar (1) and an opposite conductive adhesive side which is attached to bar (1) opposite laminate (3). This band provides an electrical contact between the laminate (3) and bar (1). Laminate (3) is charged through band (4) in the same polarity as roller(6) by a fixed potential source which contacts the back of band (4). An alternative to band (4) is to simply punch a hole in laminate (3) at the location where electrical contact is to be made and fill that hole with a conductive adhesive, such as a silicone or epoxy adhesive, which is then cured to a solid.

In a preferred embodiment the conductive band between bar (1) and laminate (3) is provided by a conductive paste comprising from about 70% to about 96% (preferably about 94% to about 96%) of a flexible elastomer having a hardness of less than about 50 Shore A when dry (such as room temperature vulcanizable silicone or latex rubber) and from about 4% to about 30% (preferably from about 4% to about 6%) of a particulate electrically conductive material (such as carbon black). This paste may also, optionally, include a conventional solvent, such as methyl ethyl ketone. These paste compositions are described in detail in the concurrently-filed patent application entitled "Electrical Contact Material For Flexible Doctor Blade," Ser. No. 08/623,362, Bracken, et al filed concurrently with the foregoing application entitled "Compliant Doctor Blade".

Located on the bottom surface of support bar (1) (i.e., the face of the support bar which is facing the developer roller) is a layer of resilient foam (2) which generally has a thickness of from about 2 to about 3 mm and runs the entire length of the support bar (1). The foam layer (2) may be attached to the underside of the support bar using any conventional adhesive material which will withstand the forces on the doctor blade during use, but in a preferred embodiment this adhesive material is a commercial dual side adhesive tape (5) which comprises 1 mil thick polyester having adhesive on both sides. A preferred foam material for use in the present invention is Poron foam, a polyurethane foam commercially available from Rogers Corp.

A shim (10) is attached to the bottom of the resilient foam layer (i.e., the face of the resilient foam layer which faces the developer roller). In selecting the shim it is important that it maintains an appropriate balance between stiffness and flexibility. Specifically, the shim must maintain stiffness in the process direction (i.e., the direction in which the developer roller is moving), yet maintain flexibility in the direction perpendicular to the process direction (i.e., over the length of the doctor blade). It is the stiffness of the shim which provides the appropriate nip configuration, while the flexibility over the length of the doctor blade allows the blade to conform closely to the surface of the developer roller. Thus, the doctor blade of the present invention provides the benefits of both an inflexible steel doctor blade and a flexible doctor blade. Any material which maintains this appropriate flexibility/stiffness balance may be used as the shim in the present invention. In deciding whether a particular material is appropriate for use as the shim, both the nature of the material and its thickness will be important. Specifically, if a material is too thin it may not provide the appropriate degree of stiffness required, while if it is too thick, it may not exhibit the required degree of flexibility. The shim may be made of any material having the required flexibility/stiffness tradeoff and is preferably a material that does not corrode and has an appropriate cost. Examples of materials which may be used include brass, phosphorus bronze, beryllium copper, polycarbonate, polyester, and stainless steel. Polyester is a particularly preferred material because it is easier than the metals to cut into the desired shape. Stainless steel is also a preferred material because of its attractive cost and the fact that it doesn't corrode.

By way of example, when stainless steel is used to make the shim, a thickness below about 0.004 inch (0.102 mm) makes the shim too fragile. When polyester (e.g., Mylar, commercially available from DuPont) is used, a thickness of material below about 0.014 inch (0.356 mm) makes the material too flexible; greater stiffness is required. On the other hand, stainless steel at a thickness of greater than about 0.012 inch (0.305 mm) is too thick and does not provide the required degree of flexibility. Thus, the thickness for the shim material selected is purely a function of the stiffness/flexibility tradeoff required. The shim material utilized in the doctor blades of the present invention should have a stiffness of from about 0.5 to about 31.0, preferably from about 10.0 to about 25.0, inches of deflection/inch of length/pound of force. This stiffness is measured as follows: a 4 mm wide shim is fixed at one end and loaded at the other (the magnitude of the load should be sufficiently low to prevent plastic deformation of the shim); the displacement of the loaded end is then measured. Put another way, the shim should have a stiffness which is greater than that of 0.014 inch thick polyester and less than or equal to that of 0.012 inch thick stainless steel.

The placement of the shim (10) on the foam layer (2) is important. Specifically, the shim (10) should be aligned with the front edge (9) of the doctor blade (i.e., the edge of the doctor blade which the developer roller encounters first in use). The shim (10) should run the entire length of the doctor blade. It is fastened onto the foam layer (2) using pressure sensitive adhesive. It is important that the adhesive not allow the shim to creep or shift position in use. This is particularly important since the shim will be under constant shear stress during use. Examples of useful adhesives include acrylic adhesives. It is preferred that the shim be fastened to the foam using an acrylic adhesive (e.g., #9469 Double Sided Tape commercially available from 3M). It is not necessary that the shim cover the entire bottom face of the foam layer, as long as it is placed at and aligned with the front edge (9) of the foam layer (2). However, it is preferred that the shim be of such size and placement that it covers the entire bottom face area of the foam layer since that makes assembly and alignment of the doctor blade much easier.

The resilient foam layer (2) may be made from any commercially available foam having the appropriate degree of resilience. Preferably, the foam (2) is a commercially available polyurethane foam having a density of about 20 lbs. per cubic foot. The foam (2) is held in place by a double sided adhesive tape (5) which is approximately 4 mm in width and 0.013 mm thick. Various alternatives to foam (2) may be readily employed. In use, when the laminate on the compliant backing member (3) is bent back as described, the inherent resilience of the foam material and the backing member provides the force for the laminate layer (3) toward the roller (6).

The doctor blade of the present invention is shown in use in FIG. 2. In use, laminate (3) is compliant and is simply bent back at a position contiguous to the developer roller (6) as it rotates. The compliant backing member (3) and the resilient foam layer (2) provide the force which holds the conductive/grit laminate against the developer roller (6). This contacts a sector of developer roller (6) which sector changes continuously as roller (6) turns during a developing operation. The stiffness of the shim (10) in the direction that the roller is turning prevents the front edge (9) of the foam from deforming; this provides a pre-nip region having an optimal shape (8). This pre-nip region is nearly identical to that seen with a steel doctor blade. The stiffness of the shim also prevents the undesired long, radiused nip geometry and the contacting portion (7) of laminate (3) identically mimics the short, flat nip geometry of a steel blade. The stiffness that the shim provides is effective only in the process direction and not along the length of the blade (i.e., the length of the roller), thereby maintaining the overall flexibility of the blade. This is due to the narrowness of the blade (preferably about 4 mm), the width of the nip (i.e., from about 0.5 to about 1.5 mm, preferably about 1 mm), and the overall length of the blade (from about 230 to about 233 mm, preferably about 231.5 mm). The preferred thickness of the shim is about 0.014 inches (0.356 mm). The preferred material is polyester.

More generally this invention encompasses putting a layer of molybdenum disulfide powder of plate structure, preferably 10 microns average particle size on the conductive surface of the flexible doctor blade. When applied as a dusted-on powder, the molybdenum disulfide quickly wears away in the nip, but remains at the pre-nip. The presence of molybdenum disulfide at the pre-nip prevents the initiation site for filming, thus filming does not occur.

On corresponding uncoated doctor blades, filming begins to occur with use within the normal useful life of the doctor blade. The coated blades have been shown to exhibit no fill after use for three times the normal useful life of the doctor blade. Molybdenum disulfide coated doctor blades when used in high temperature, high pressure conditions, do not change morphology. Molybdenum disulfide does not change significantly the triboelectric properties of the doctor blade, those properties being significant in the charging of the toner.

While applying the molybdenum disulfide to the surface of the coating is effective, it is expensive since it is a separate operation. Incorporating the molybdenum disulfide into the coating is equally effective and reduces costs. The incorporation has an added benefit of not wearing away within the nip. One additional benefit of the incorporation is improved die cutting of the film, since molybdenum disulfide is a known solid lubricant, resulting in easier trimming and lower tool wear.

Variations in the form and in the materials used are readily visualized and would be within the contemplation of this invention. Coverage is sought as provided by law, with particular reference to the accompanying claims.

We claim:

1. A compliant blade for metering charged electrophotographic toner held on a developer roller by physically contacting a sector of said roller with an electrically conductive surface of said blade, said electrically conductive surface at least in the region prior to said contacting comprising molybdenum disulfide in plate form particles to reduce filming.

2. The compliant doctor blade as in claim 1 in which said molybdenum disulfide is a powder applied to the outside at said blade.

3. The compliant doctor blade as in claim 1 in which said molybdenum disulfide is incorporated into a binder resin which forms said electrically conductive surface.

4. The compliant doctor blade as in claim 3 in which said molybdenum disulfide has an average particle size of about 10 microns.

5. The compliant doctor blade as in claim 1 in which said molybdenum disulfide has an average particle size of about 10 microns.

6. The compliant doctor blade as in claim 2 in which said molybdenum disulfide has an average size of about 10 microns.

7. The compliant doctor blade as in claim 3 in which said binder also has incorporated in it ceramic oxide grit particles of about 20 micron particle size.

8. The compliant doctor blade as in claim 7 in which said molybdenum disulfide has an average particle size of about 10 microns.

9. The compliant doctor blade as in claim 8 also comprising about 5 percent by weight conductive carbon black, about 30 percent by weight said molybdenum disulfide and about 50 percent by weight said grit.

10. The compliant doctor blade as in claim 9 in which said grit is silicon carbide.

* * * * *